US011198595B2

(12) United States Patent
Morse et al.

(10) Patent No.: US 11,198,595 B2
(45) Date of Patent: Dec. 14, 2021

(54) METHODS AND APPARATUSES FOR INSTALLING ELEVATOR MACHINES

(71) Applicant: TK Elevator Innovation and Operations GmbH, Duesseldorf (DE)

(72) Inventors: Justin Charles Morse, Memphis, TN (US); Zachary William Evans, Cordova, TN (US); William E. Bowling, Bloomington, IN (US); Andrew Turner Bottom, Memphis, TN (US); Andrew Taylor, Memphis, TN (US); Garret Stone, Memphis, TN (US)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 364 days.

(21) Appl. No.: 16/295,065

(22) Filed: Mar. 7, 2019

(65) Prior Publication Data

US 2020/0283271 A1 Sep. 10, 2020

(51) Int. Cl.
*B66B 19/00* (2006.01)

(52) U.S. Cl.
CPC ..... *B66B 19/005* (2013.01)

(58) Field of Classification Search
CPC .. B66B 19/007; B66B 11/0045; B66B 19/005
See application file for complete search history.

(56) References Cited

U.S. PATENT DOCUMENTS 3,851,736 A * 12/1974 Westlake ..... B66B 19/002 52/745.2
2004/0084251 A1* 5/2004 Miller ..... B66B 19/005 187/254
2009/0097952 A1* 4/2009 Swaybill ..... B66B 19/005 414/589

FOREIGN PATENT DOCUMENTS

EP 1673302 B 12/2011
EP 1593641 B 12/2014

* cited by examiner

*Primary Examiner* — Diem M Tran
(74) *Attorney, Agent, or Firm* — William J. Cassin

(57) ABSTRACT

An installation tool configured to install a machine of an elevator system, including a base section including two legs, each leg including a laterally extending gusset attached thereto. A clamp assembly is supported by the base section and includes a first bracket attached to and positioned over the two legs and a second bracket attached to and positioned over the gussets. A first tube is movably carried by the first bracket and a second tube is movably carried by the second bracket. The first and second tubes are movable in the brackets between a retracted position that positions the machine over the base section and an extended position that positions the machine in a cantilevered position adjacent the retracted position. Each of the first tube and the second tube includes a tube clip that is fixed in position thereon and a first rod is movably disposed in the first tube and a second rod is movably disposed in the second tube, each of the first and second rod including a rod clip sized and shaped to releasably retain the machine on the clamp assembly in cooperation with a respective tube clip.

13 Claims, 7 Drawing Sheets

METHODS AND APPARATUSES FOR INSTALLING ELEVATOR MACHINES

FIELD OF THE DISCLOSURE

The present disclosure generally relates to elevators, including methods and apparatuses for installing elevator machines, also knows as elevator drives, and optionally also other elevator elements.

BACKGROUND

Equipment for mounting an elevator drive in the shaft head region of an elevator system is well-known. According to one system, the equipment may include a counterweight frame movable along guide rails, an arm, fixture, or jig arranged at the counterweight frame and a hoist. The hoist is loaded with the elevator drive at a lower floor and then raised by means of actuating the hoist, which engages at the counterweight frame, until, while in the shaft head region, the fixture operates to hold the machine at or near the final installation site while the machine is transferred from the fixture to the final site and installed.

Current machine installation tools are assembled on site from numerous parts and affixed to the crosshead of the elevator frame. One such design consists of two crosshead interface attachment plates, outriggers and a great number of small parts, which takes a team of workers a significant amount of time to safely assemble and install. In addition, one such tool requires interface tooling used to connect the tool to the crosshead and also requires that the machine be bolted to the tool.

In the ongoing quest for increases in efficiency and lower costs with respect to installing elevator systems, there is a need for methods and apparatuses that provide for a reduction of the time required to assemble an installation tool for elevator drives and furthermore includes features that operate to increase the safety and efficiency of machine installation and alternatively additional elevator elements using such an installation tool.

DETAILED DESCRIPTION

Although certain example methods and apparatuses are described herein, the scope of coverage of this patent is not limited thereto. On the contrary, this patent covers all methods, apparatuses, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claim need not necessarily be performed in the order in which they are recited, unless so required by the context of the claims. In addition, all references to one skilled in the art shall be understood to refer to one having ordinary skill in the art.

Figure 1:
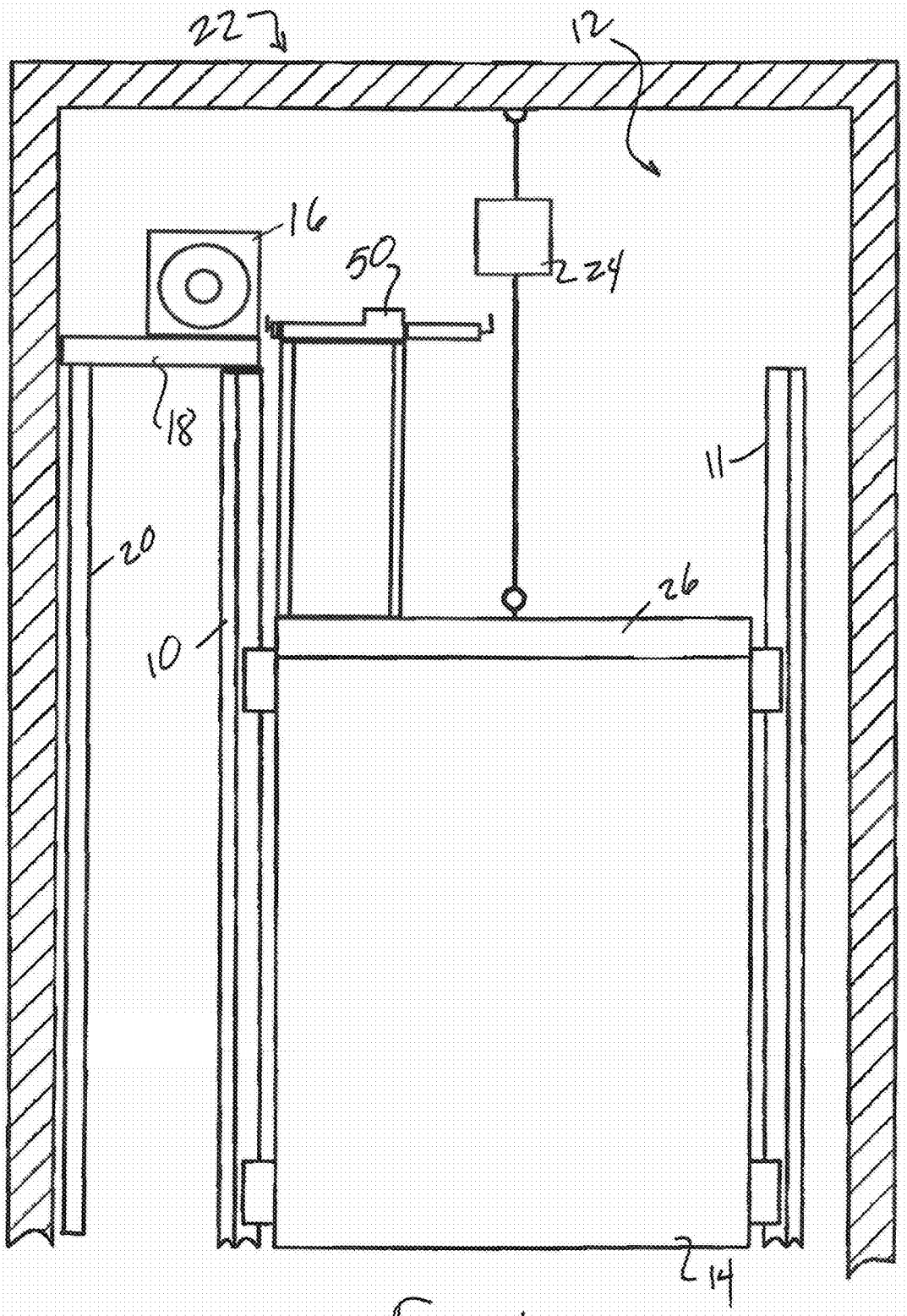
FIG. 1 is a front view of an elevator system, elevator shaft, and elevator components including an installation tool in use according to the present disclosure.

Referring now to FIG. 1, the method of the disclosure may be implemented in an elevator system 22 of the type having no machine room and having ropes or flat traction belts for operating the elevator car 14, with the car guide rails 10, 11 and counterweight rails 20 fixed in an elevator hoistway 12 and the car itself and the counterweight (not shown) positioned on their respective rails. The illustrated counterweight rails 20 will be understood to include the main car rail. Other types of elevator systems are contemplated. The method has an objective of positioning and mounting the drive machine 16 of the car on a support frame 18, such as, for example, a rail cap that is fixed at the top of a car guide rail 10 and/or laterally and in the rear to the counterweight guides 20 on a same side of the elevator hoistway 12. It will be understood that FIG. 1 is a representative illustration and simplified to show aspects of the disclosure.

It will be understood that the drive machine 16 may be a conventional electrically operated motor and brake assembly housed in a suitable housing. In addition, the rail cap 18 may be configured as or may include a conventional support frame for the drive machine 16.

The drive machine 16, and optionally also the rail cap 18, is installed via installation tool 50, according to the present disclosure, which is configured, as will be discussed in detail hereinbelow, to receive, hold, guide, locate, and align the drive machine into position for installation of the machine for the operation of the elevator system 22.

Generally, in FIG. 1, the car 14 is positioned vertically in the hoistway 12 by a temporary hoist 24 by attachment of the hoist to a crosshead 26 or similar frame part of the car by a rope or the like as is well known. It will be understood that a similar well-known method of transferring the rail cap 18 and the machine 16 to the tool 50 for installation may be provided by way of a separate hoist (not shown).

Positioning the car 14 in the hoistway 12 provides working space and a working platform for installation of elevator elements at or near the head of the hoistway. The hoist 24 may be used to position the car 14 and in so doing provides for a mechanism to also position the tool 50 and thus the machine 16 vertically for installation purposes. The installation tool 50 is attached directly to the crosshead 26 by conventional, removable fasteners (see FIG. 4) not shown) such as bolts and nuts. The machine 16, as shown in FIG. 1, has been positioned and installed atop the rail cap 18 by movement of a positioning mechanism of the tool 50 and a transfer from the installation tool to the rail cap.

Figure 2:
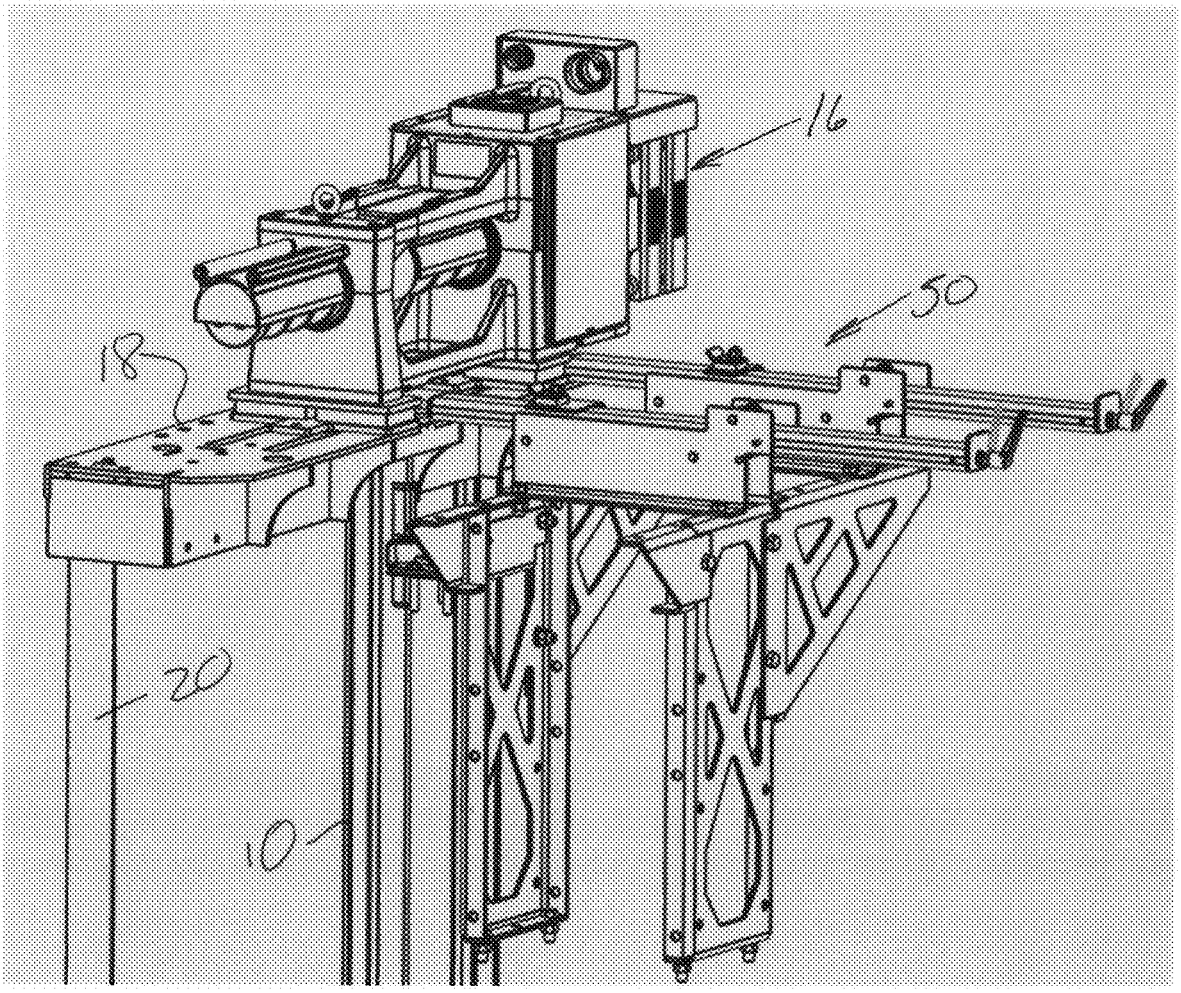
FIG. 2 is a perspective view of the installation tool, machine and related components of the elevator system.

FIG. 2 shows the installed rail cap 18 and the guide rail 10 and counter weight rails 20. The installation tool 50, shown in a partially retracted state, is positioned such that the machine 16 is positioned atop the rail cap 18 and in position to be secured thereto.

Figure 3:
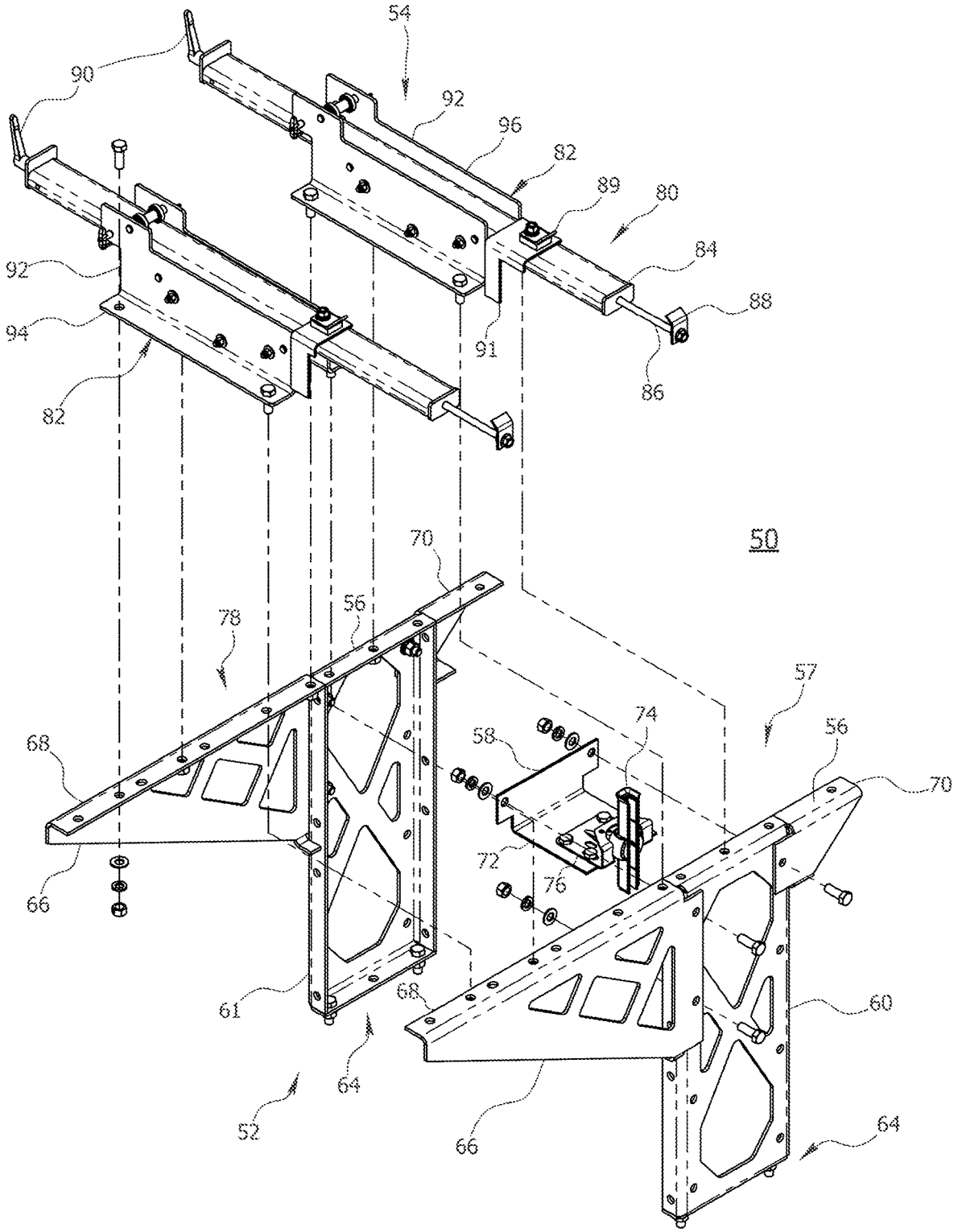
FIG. 3 is an exploded perspective view of the installation tool of the present disclosure.

FIG. 3 shows the installation tool in an exploded view. The installation tool 50 can be considered to include a base section 52 and a clamp and positioning assembly 54 mounted to the base section. A guide assembly 58 is mounted at or near a top portion 56 of the base section 52 in a position to provide support (see FIG. 2) to the clamp assembly 54 of the installation tool 50.

Figure 4:
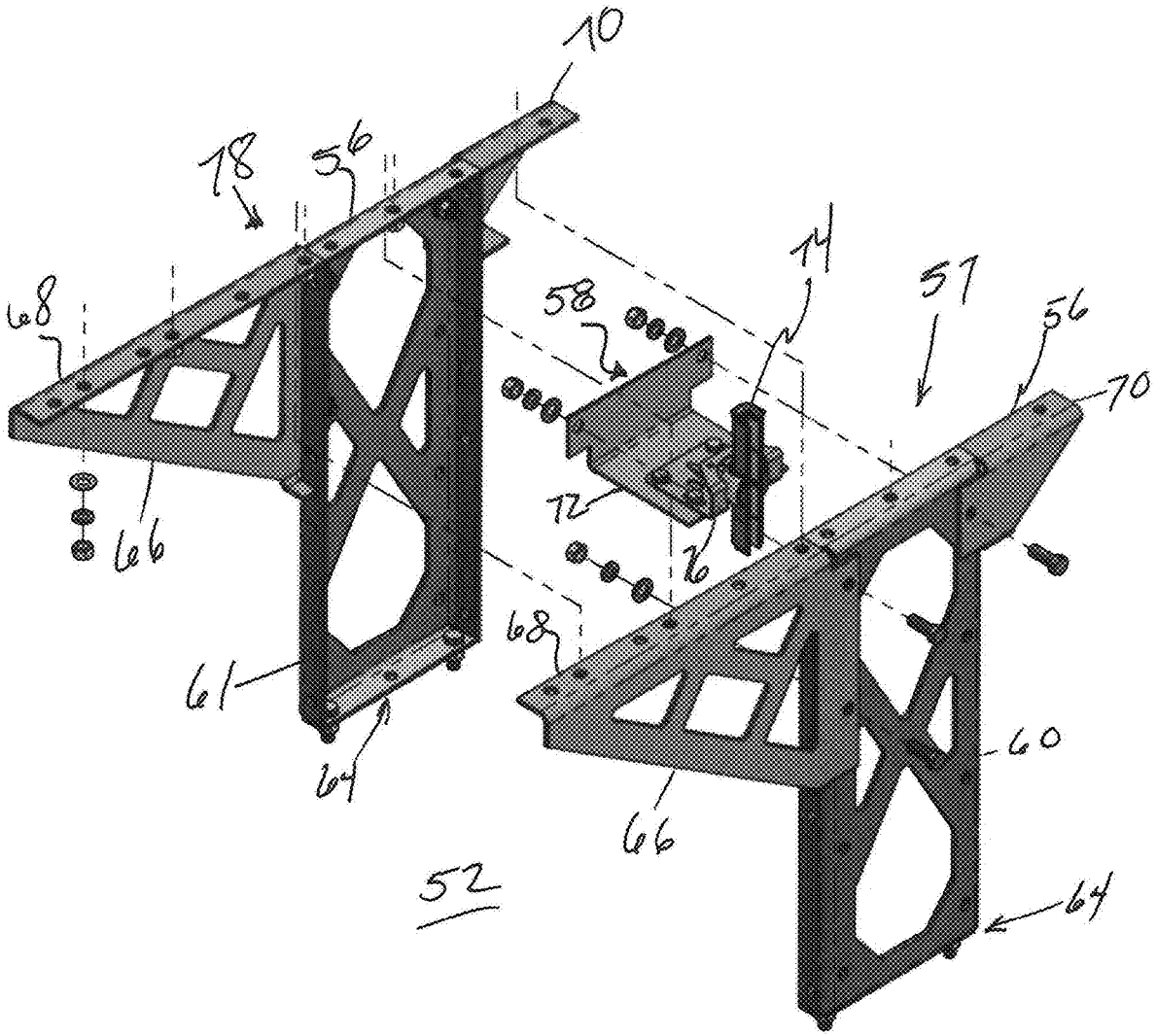
FIG. 4 is an exploded perspective view of the base section of the installation tool of FIG. 3.

Generally, the base section 52, shown in detail in FIG. 4, includes a pair of spaced legs 60, 61. The pair of legs include a front leg 60, which when installation is in process is fastened directly to the crosshead 26 and positioned adjacent the installed rail cap 18 (see FIG. 1) and a rear leg 61, which, in use is also fastened directly to the crosshead. The legs 60, 61 are fixed in place on the crosshead 26 in a spaced apart configuration to provide stability to the installation tool 50.

Each of the legs 60, 61 may be a vertically oriented rectangular beam structure or rectangular box shape. Each of the legs 60, 61 may be formed with cutouts or spaces 62, preferably in areas that are not subject to a significant amount of loading so as to reduce weight of the component. It will be understood that the legs 60, 61 may have any suitable shape and size for supporting a machine of an elevator system. The legs 60, 61 may be made of steel or any suitable material.

The top ends 56 of each of the legs 60 form a flat platform 57 with openings formed therethrough for receiving conventional removable fasteners, such as bolts secured with nuts and washers as is well known for such structural members for securing the clamp assembly 54 thereto. Lower ends 64 of each of the legs are provided with openings for conventional removable fasteners, such as bolts secured with nuts and washers and are configured to be attached directly to the crossbeam or crosshead 26 (see FIG. 1) via nuts and bolts in a spaced-apart configuration so as to be stable when the installation tool 50 is loaded with a machine. The base section 52 may be formed of steel or any suitable material, such as other metals, alloys of metals, composite materials, or other sufficiently strong materials capable of supporting a machine.

Each of the legs 60 includes a gusset 66 attached at or near the top end 56 thereof. Each of the gussets 66 may be triangular in configuration and extends outwardly from a side of the leg 60. Each gusset 66 includes a top surface 68 that is substantially (within standard manufacturing tolerances) coplanar with the platform 57 of the legs 60, 61. The tops 56 of the legs 60, 61 and the top surface 68 of the gussets 66 together provide a wide and stable base or platform 78 on which the clamp assembly 54 is mounted. In one embodiment, one part of the clamp assembly 54 is fastened directly atop the legs 60, 61 and the other part of the clamp assembly is fastened atop the gussets 66. It may be particularly advantageous to configure the tool 50 such that most of the weight of the machine 16 is located over the legs 60, 61.

Each of the legs 60 also includes an optional wing structure 70 attached opposite a respective gusset 66. Each wing structure 70 is a smaller version of a gusset 66, and which is generally triangular in configuration and extends outwardly to extend the length of mounting surface 78 formed by the tops 57 of the legs 60, 61 and the top surface 68.

Figure 5:
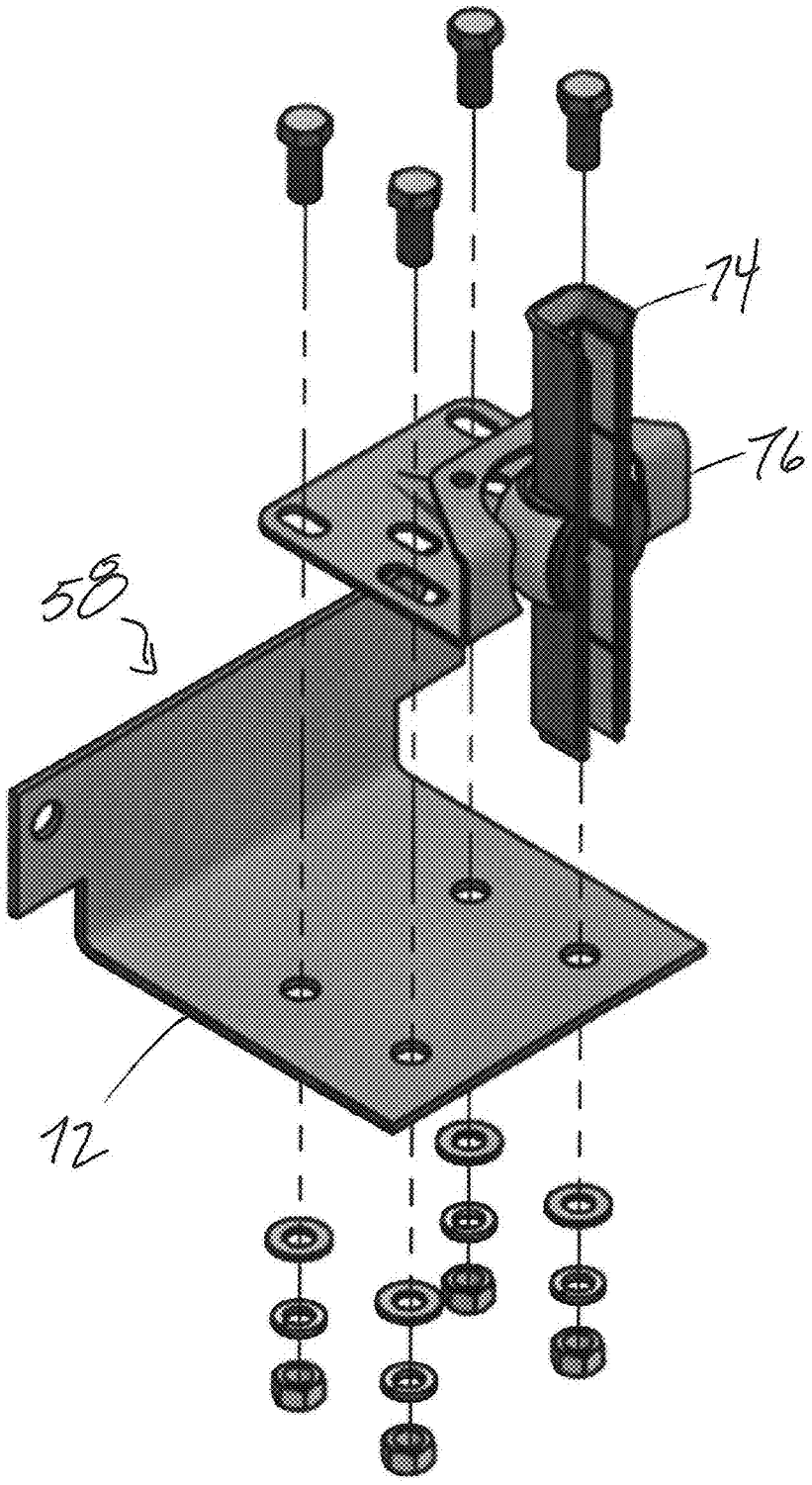
FIG. 5 is an exploded perspective view of a guide assembly portion of the installation tool of FIG. 3.

The guide assembly 58, shown in detail in FIG. 5, is attached to a leg 60 to support the tool 50 when the machine is attached to the clamp assembly 54 as will be explained in more detail below. The guide assembly 58 is mounted to the front leg 60 via an L-shaped angle 72 that is configured to be attached, e.g., via bolts and nuts, to the inside or outside of the leg. The guide assembly 58 includes a slide guide 74. The slide guide 74 is adjustably securable in a number of positions, horizontally and rotatably, and is sized and shaped to contact an adjacent car rail to transfer and disperse the force of the cantilevered machine to the rail so as to prevent a large moment on the tool. The slide guide 74 is attached to the L-shaped angle 72 by way of a slide plate 76. The slide plate 76 is laterally (horizontally) adjustable to the angle 72 by slotted openings in the slide plate, which permit the slide plate 76 to be adjustably fixed, via nuts and bolts for example, to the angle 72 in a number of positions delimited by the length of the openings. The guide assembly 58 may also be formed of steel or any other suitable material.

Figure 6:
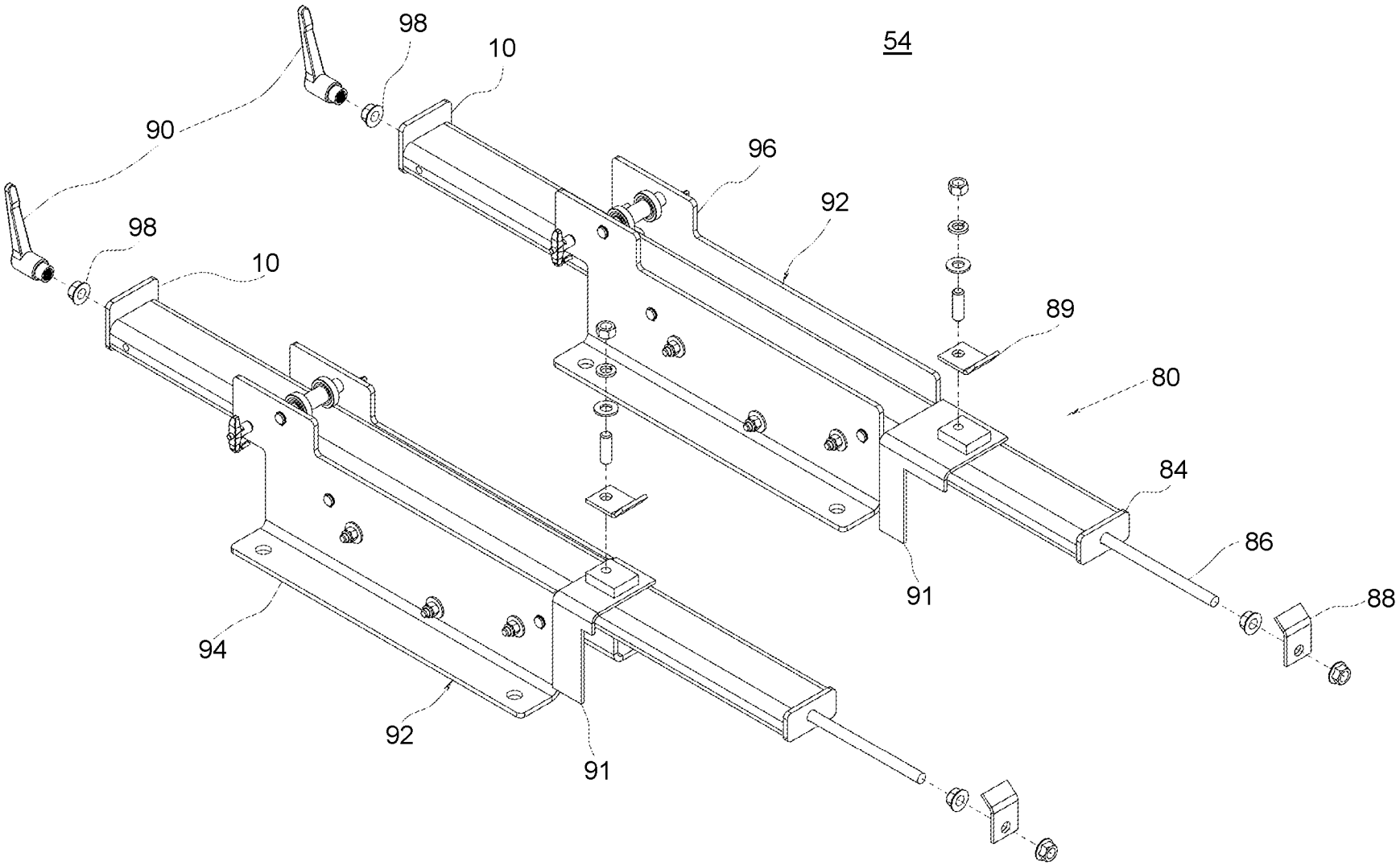
FIG. 6 is an exploded perspective view of a clamping and positioning assembly of the installation tool of FIG. 3.

The clamp assembly 54, shown in detail in FIG. 6, is attached to the platform 78 formed by the tops of at least the legs 60, 61 and gussets 66. The clamp assembly 54 includes two clamp mechanisms 80. Each of the clamps 80 includes a bracket assembly 82 and a tube 84 that is slidably/movably disposed in the bracket assembly in an at least a lateral or horizontal direction.

Each tube 84 includes a threaded rod 86 rotatably and slidably disposed within the tube 84. The threaded rod 86 operates a clamp including a pair of opposed clips 88, 89 or angled pieces on or near one end of the tube via manipulation of a handle 90 that is attached to the rod 86 at an end opposite the clamp 80. Each of the clamp clips 88, 89 are sized and shaped to fit to and secure the machine when the machine is mounted atop the clamp assembly 54 between the two pairs of opposed clips 88, 89. The clamp assembly 54 may also be used to hold the rail cap for installation in a similar manner as that of the machine.

One clip 88 of each of the pairs of clamp clips 88, 89 is attached to the terminal end of a rod 86 and the other clip 89 of each of the pairs of clamp clips 88, 89 is attached to a respective tube 84. The terminal clip or rod clip 88 moves with the rod 86 to which it is attached and the other clip or the tube clip 89 is configured to be fixedly attached to the tube 84 to form a clamping pair. Further, the tube clip 89 may be attached to the rod 86 by way of a stop 91 that is attached to the tube 84 and is shaped to delimit the movement of the tube 84 in the bracket assembly in a retracted state by contacting the stop 91 with the bracket 92 that movably carries the rod 86. The tubes 84 each may also have a tube stop 100 at the end of the tube 84 adjacent the handle 90, the tube stops 100 being shaped to stop the horizontal travel of respective tubes 84 at the extended position to position the machine 16 properly over the rail cap 18 (see FIG. 2) and prevent the tubes 84 from traveling too far and possibly being disengaged from brackets 92 and dropping the machine.

The clamp assembly 54 is attached to the platform 78 by way of paired brackets 92, each pair of which has a tube 84 movably disposed therebetween. The bearing assembly brackets 92 may be a pair of L-shaped brackets that attach to the platform 78 at one portion thereof and bracket the tube 84 at the other portion thereof. The brackets 92 attach the legs 60, 61 to each other at the top ends thereof 56 and support the longitudinal/horizontal movement of the tubes 84. The tubes 84 may be cylindrical, rectangular, square or any suitable shape. Preferably, the tubes 84 are shaped to provide a stable platform for receiving the machine 16 or the like.

The brackets 92 each have a selected height measured from the platform 78, which height is an extent suitable for supporting the machine. In one embodiment, a first one 94 of the brackets 92 has a first height and a second one 96 of the brackets 92 has a second height sized and shaped to support the machine in a level position, because the bottom of the machine is not planar, that enables the machine to be transferred to an installed state in the elevator system in a desired orientation without further positional adjustment. The tubes 84 are slidably disposed in the brackets 92.

Figure 7:
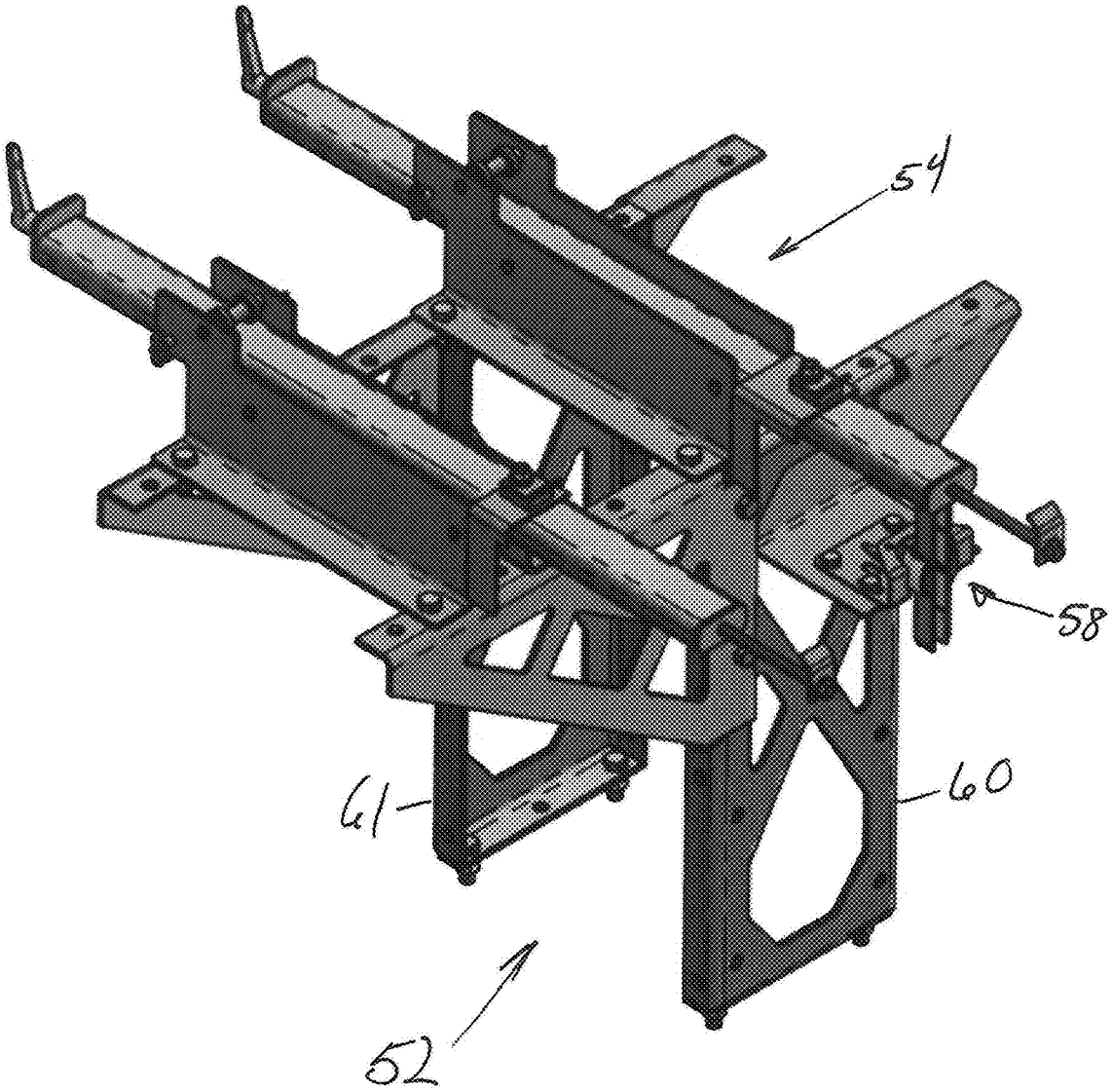
FIG. 7 is a perspective view of the assembled installation tool of FIG. 3.

The configuration illustrated in FIG. 6 shows the retracted state of the tool 50. In the retracted state, the machine 16, when secured by way of the clamp assembly 54 is located over and adjacent leg 60, which provides stability to the tool 50 and machine 16 before installation. The handles 90 can be drawn horizontally out of the tubes 84 to secure the machine between the opposed pairs of clips 88, 89. A locknut 98 on rod 86 can be manipulated to secure the machine on the clamp assembly 54 in the retracted state. FIG. 7 shows the tool 50 in an assembled state.

In use, and referring to the figures, with the machine 16 secured to the tool 50 via the clamp assembly 54, the machine can be released from attachment to the winch (not shown). The guide assembly 58 may be adjusted previous to lowering of the machine into position on the tool 50, wherein the slide guide supportingly contacts the underside of one of the rods 84 located over and spanning the center of the base section 52 to provide stability.

The car 14 is raised such that the bottom of the machine 16 is slightly vertically higher than a mounting surface of the rail cap 18. The clamp assembly 54 is then moved from the retracted state to an extended state by moving the tubes 84 toward the rail cap 18. The advancement of the machine 16 is caused by the movement of the tubes 84 because the machine is secured to the tubes via the clamp clips 88, 89. When the machine 16 is moved into horizontal position over the rail cap 18, the car 14 is lowered such that the machine rests in position on the rail cap 18 and the machine can be secured to the rail cap in a conventional manner. The machine 16 is released from the clamp assembly 54 by releasing the locks 98 and optionally rotating the clips 88, 89 out of contact with the machine. The tubes 84 are retracted from underneath the machine 16 and returned to a retracted position to disengage the installation tool from the machine and complete the installation process. Because the installation tool 50 is mounted directly to the crosshead 26 and consists of only a few subsections, it can be assembled onto the crosshead and unassembled therefrom easily and quickly. After the machine 16 is installed, the installation tool 50 can be disassembled from the crosshead 26, removed from the hoistway and completion of the installation of the elevator system 22 can progress conventionally.

Although FIGS. 1-7 and the above text disclose various example apparatuses and various example methods, those having ordinary skill in the art will recognize that the example apparatuses and example methods referenced herein may be modified in a multitude of ways without departing from the scope of the present disclosure.

What is claimed is:

1. An installation tool configured to install a machine of an elevator system, comprising:

a base section including two legs, each of the two legs including a laterally extending gusset attached thereto;

a clamp assembly supported by the base section, the clamp assembly including:

a first bracket attached to and positioned over the two legs and a second bracket attached to and positioned over the gussets;

a first tube movably carried by the first bracket and a second tube movably carried by the second bracket, the first and second tubes movable in the brackets between a retracted position that positions the machine over the base section and an extended position that positions the machine in a cantilevered position adjacent the retracted position;

each of the first tube and the second tube including a tube clip that is fixed in position thereon; and a first threaded rod movably disposed in the first tube and a second threaded rod movably disposed in the second tube, each of the first threaded rod and second threaded rod including a rod clip sized and shaped to releasably retain the machine on the clamp assembly in cooperation with a respective tube clip.

2. The installation tool of claim 1, wherein the base section is configured to attach directly to a crosshead of the elevator system.

3. The installation tool of claim 2, wherein the first and second brackets are sized and shaped to receive the machine thereon and maintain the machine in a horizontal orientation during installation.

4. The installation tool of claim 1, wherein the base section and the gussets form a platform configured to receive the clamp assembly.

5. The installation tool of claim 1, wherein the first and second brackets each include a pair of L-shaped members sized and shaped to receive a respective one of the first and second tubes therebetween.

6. The installation tool of claim 1, wherein the first and second tubes are horizontally movable within the first and second brackets.

7. The installation tool of claim 1, wherein the first and second tubes each have a stop that is positioned so as to abut a respective one of the first and second brackets when the first and second tubes are in the retracted position.

8. The installation tool of claim 7, wherein the tube clips are each fixed to a respective stop.

9. The installation tool of claim 7, wherein the first and second tubes each have a tube stop that is positioned so as to abut a respective one of the first and second brackets when the first and second tubes are in the extended position.

10. The installation tool of claim 1, wherein the first threaded rod and second threaded rod are threadably engaged with respective first and second tubes.

11. The installation tool of claim 10, wherein each of the first threaded rod and second threaded rod include a locknut threadably disposed thereon.

12. The installation tool of claim 11, wherein the locknuts are positioned so as to lock the first threaded rod and second threaded rod in position relative to the first and second tubes.

13. The installation tool of claim 12, wherein with the machine secured by the rod clips and the tube clips the locknuts are rotatably displaceable against respective first and second tubes to lock the first threaded rod and second threaded rod in position.

* * * * *